United States Patent [19]

Roccaforte

[11] 4,260,059

[45] Apr. 7, 1981

[54] CONTAINER HAVING AN INTERNAL SUPPORT FOR FRAGILE ARTICLES AND BLANK THEREFOR

[75] Inventor: Harry I. Roccaforte, Western Springs, Ill.

[73] Assignee: Champion International Corporation, Stamford, Conn.

[21] Appl. No.: 44,636

[22] Filed: Jun. 1, 1979

[51] Int. Cl.[3] ..... B65D 5/48

[52] U.S. Cl. ..... 206/588; 206/418; 229/15; 229/27

[58] Field of Search ..... 206/45.14, 418, 419, 206/420, 588; 229/27, 15

[56] References Cited

U.S. PATENT DOCUMENTS

| | | | |
|---|---|---|---|
| Re. 28,530 | 8/1975 | D'Alessio | 229/27 |
| 2,611,529 | 9/1952 | Currivan | 229/27 |
| 3,182,885 | 5/1965 | Maio | 206/418 X |
| 3,313,466 | 4/1967 | Keith | 229/27 |
| 3,356,281 | 12/1967 | Buttery | 229/27 |
| 3,547,256 | 12/1970 | Bolding | 206/418 |
| 3,853,259 | 12/1974 | Tupper | 229/15 |
| 3,968,924 | 7/1976 | Tyrseck | 206/418 |

FOREIGN PATENT DOCUMENTS

| | | | |
|---|---|---|---|
| 1021396 | 12/1952 | France | 206/418 |

*Primary Examiner*—Joseph Man-Fu Moy
*Attorney, Agent, or Firm*—Evelyn M. Sommer

[57] ABSTRACT

A multi-sided container, preferably formed of a unitary blank, having an internal support formed of two hingedly connected divider panels receiving a fragile article, such as a light bulb, therebetween. One of the divider panels is hingedly connected to a glue flap which also interconnects a plurality of panels to form the multi-sided container. The divider panels have V-shaped notches at the tops thereof, and at least one divider panel has an aperture therein for receiving a part of the fragile article.

41 Claims, 21 Drawing Figures

CONTAINER HAVING AN INTERNAL SUPPORT FOR FRAGILE ARTICLES AND BLANK THEREFOR

The present invention relates to a container, formed of a unitary blank of paper board or cardboard, having an internal support for fragile articles, such as light bulbs. The invention also relates to the configuration of the unitary blank forming the container.

Fragile items, such as projector lamps or other specialized small lamps or bulbs, require protection during shipment. Usually, these fragile articles are packaged in small cartons with protective material, such as plastic foam, surrounding the article and separating it from the walls of the carton. However, this plastic foam is expensive and the use of automated equipment associated with constructing and loading such a carton is not easily accomplished. Moreover, many of the cartons utilized to ship such fragile articles come in numerous sizes, which are usually much larger than the fragile article to be contained therein resulting in an extravagant use of protective material.

Accordingly, it is a main object of the present invention to overcome the limitations and drawbacks associated with the prior art containers set forth above and to provide a new and improved container with an internal fragile article support.

Another object of the present invention is to provide a container having a fragile article internal support in which the container is formed from a unitary blank of material, such as paper board or cardboard.

Another object of the present invention is to provide a container having a fragile article internal support in which the container is economically produced with a minimum amount of material and which can be formed at a high production speed using automated methods.

Another object of the present invention is to provide a container having a fragile article internal support in which the container can be formed with a minimum amount of folding steps.

Another object of the present invention is to provide a container for fragile articles which provides a cheap but very effective support and protective enclosure for the fragile article inside the container.

Another object of the present invention is to provide a container for fragile articles which can be made in only two sizes but can accommodate a large number of different types of fragile articles, such as specialized bulbs or lamps.

The foregoing objects are basically attained by providing a container comprising a front panel, a rear panel, and first and second side panels hingedly connected along generally parallel fold lines forming an enclosed chamber; a glue flap interconnecting one of the side panels and the rear panel; and divider means located in the chamber for supporting the fragile article, the divider means hingedly extending along a fold line from the glue flap.

More specifically, the divider means comprises a first divider panel hingedly extending from the glue flap and a second divider panel hingedly extending along a fold line from the first divider panel, these divider panels defining therebetween an area for receiving the fragile article.

The divider panels have substantially V-shaped notches in the top edges to act as a funnel to assist in maneuvering of a fragile article into the area between the panels, and also to support a fragile article having sidewise extending shoulders so that the article does not contact the bottom of the container.

In addition, one of the divider panels has a circular aperture for receiving a partion of the fragile article, such as a substantially spherical bulb thereon.

The embodiment of the present invention shown in FIGS. 1–9 comprises a blank and container formed thereby in which the divider panels extend from a glue flap which is hingedly connected to a side panel of the blank.

The embodiment shown in FIG. 10 has a blank similar to that shown in FIG. 1; however, the overall vertical length of the panels is increased, including the length of the divider panels, so that larger fragile articles can be contained therein.

In FIGS. 11–18, a modified blank and container are depicted in which the glue flap hingedly extends from the rear panel of the blank.

In FIG. 19, a blank is shown which is similar to that shown in FIG. 11; however, the overall vertical length of the panels is increased, including the length of the divider panels, so that larger fragile articles can be contained therein.

The embodiment shown in FIGS. 20–21 comprises a blank and container similar to that shown in FIGS. 1–9 but having the vertical length of the panels increased, including the length of the divider panels, each of the divider panels being provided with an aperture and a series of score lines therein for wedgeably containing fragile articles therebetween.

The embodiments shown in FIGS. 1–10 and 20–21 can be formed into a flat sleeve configuration by means of folding the blank only about four fold lines. In the embodiments shown in FIGS. 11–19, the blank can be formed into a flat sleeve configuration by means of folding the panels along only three fold lines.

Referring not to the drawings which form a part of this original disclosure:

Figure 1:
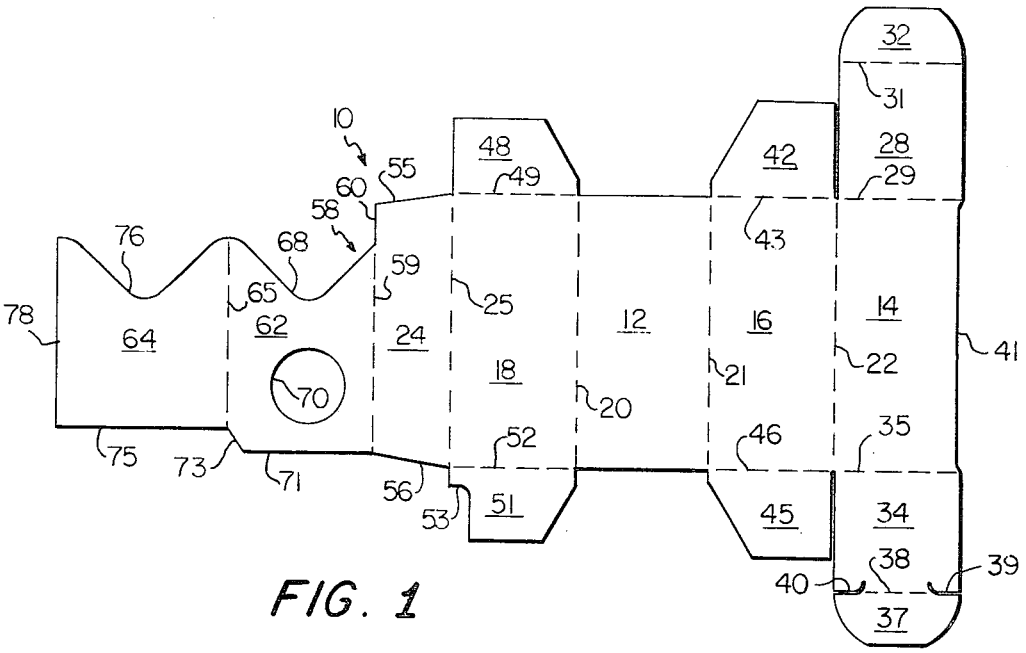
FIG. 1 is a side elevational view of a blank in accordance with the present invention showing the inside surface thereof, the dashed lines representing fold lines.
Figure 20:
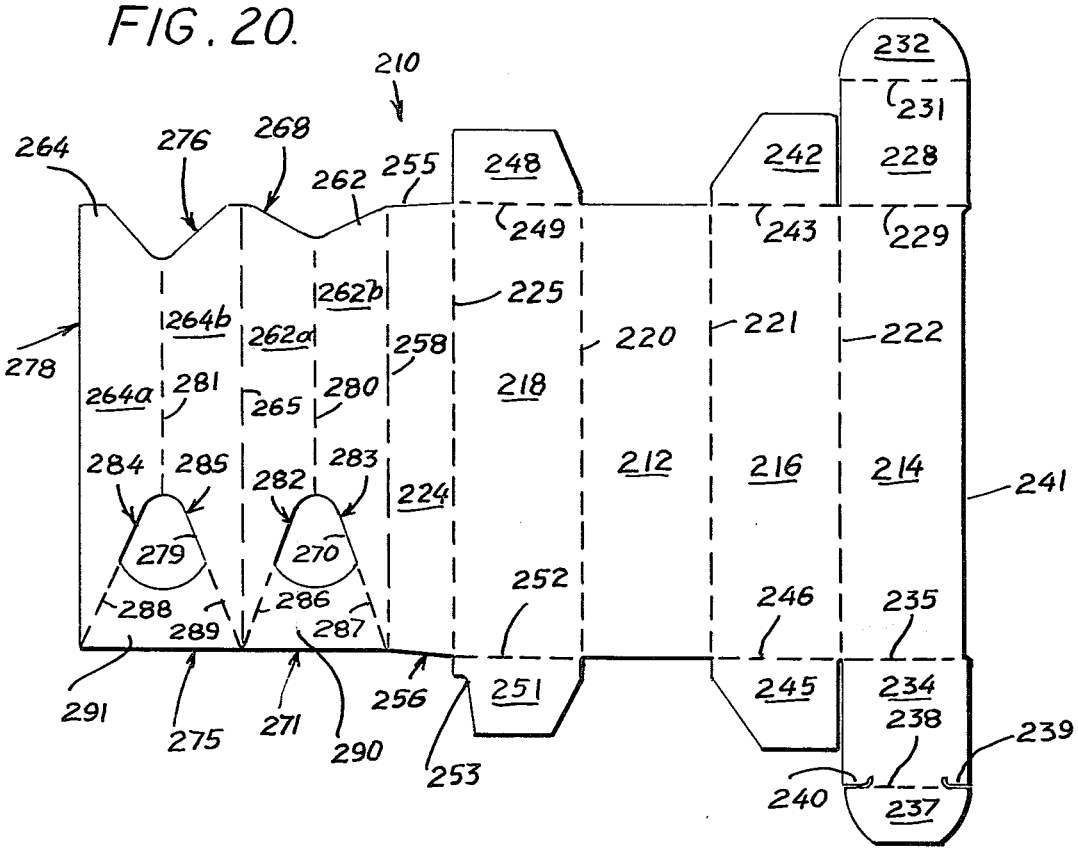
Figure 21:
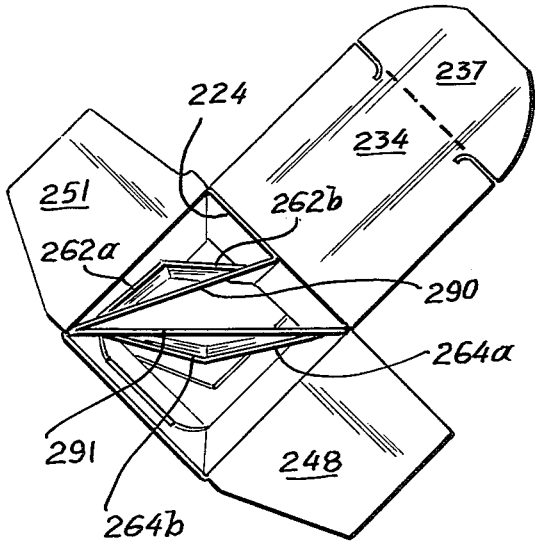

FIG. 20 is a side elevational view of another modified blank in accordance with the present invention showing the inside surface thereof, similar to that shown in FIG. 1, but having the vertical length of each of the panels increased, each of the divider panels being provided with an aperture and a series of score lines therein: and FIG. 21 is an enlarged bottom plan view of the container formed from the blank of FIG. 20.

Referring now to the drawings in further detail, the unitary blank 10 show in FIG. 1 is preferably formed of thin, foldable and bendable paper board or cardboard. The blank is comprised of a front panel 12, a rear panel 14, a first side panel 16 and a second side panel 18, all of which are rectangular and are hingedly connected respectively along parallel fold or hinge lines 20, 21, and 22. These fold lines are preferably formed in the blank 10 by means of a light scoring of the material. In addition, a glue flap 24 hingedly extends along fold line 25 from an edge of the second side panel 18. Parallel fold lines 20, 21, 22 and 25 define corners of the panels 12, 14, 16 and 18 have the same vertical length shown in FIG. 1.

The first side panel 16 and the second side panel 18 are on opposed side of the front panel 12, the sides being defined by fold lines 20 and 21. The second side panel 18 is interposed between the glue flap 24 and the front panel 12. The sides of the second side panel 18 are fold lines 20 and 25. The first side panel 16 is interposed between front panel 12 and rear panel 14, the rear panel hingedly extending along fold line 22 from the first side panel 16. The width and length of the two side panels are the same and the width and length of the front and rear panels are the same.

The rear panel 14 has a rectangular top closure flap 28 hingedly extending along fold line 29 from the top thereof and closure flap 28 has hingedly extending along fold line 31 at the top thereof of a tuck flap 32. The length of flap 28 is about equal to the width of panel 16.

The rear panel 14 also has a rectangular bottom closure flap 34 hingedly extending along fold line 35 from the bottom thereof, which closure flap has a locking flap hingedly extending from the bottom thereof along fold line 38. On opposed sides of the fold line 38 are cut lines 39 and 40. A substantially straight distal edge 41 on panel 14 extends between and is perpendicular to fold lines 29 and 35. The length of flap 34 is about equal to the width of panel 16.

The second side panel 16 has a top closure flap 42 in the form of a substantially right trapezoid extending along the top thereof from fold line 43. The length of the top closure flap 42 is less than the length of top closure flap 28 and is substantially equal to the width of front panel 12.

A bottom closure flap 45 having a substantially right trapezoidal shape hingedly extends along fold line 46 from the bottom of second side panel 16. The dimensions of this closure flap 45 are the same as closure flap 42.

The first side panel 18 has a top closure flap 48 in the form of substantially a right trapezoid which hingedly extends from the top of panel 18 along fold line 49. A bottom closure flap 51 hingedly extends along fold line 52 from the bottom of side panel 18, this closure flap also being substantially in the form of a right trapezoid; however, a recess is formed on the left edge thereof to define a locking flange 53. These two closure flaps 48 and 51 are smaller than closure flaps 42 and 45.

The top closure flaps 28, 42 and 48 form the top closure for the container, with flap 28 being the outermost top closure flap upon closing of the container.

The bottom closure flaps, 34, 45 and 51 form the bottom closure for the container, with flap 34 being the outermost flap on the bottom closure once the container is closed at the bottom.

Fold lines 49, 43 and 29 extend along the same line, and fold lines 52, 46 and 35 extend along the same line. Fold lines 49, 43 and 29 are parallel to fold lines 52, 46 and 35, and all of these fold lines are perpendicular to fold lines 25, 20, 21 and 22.

Figure 7:
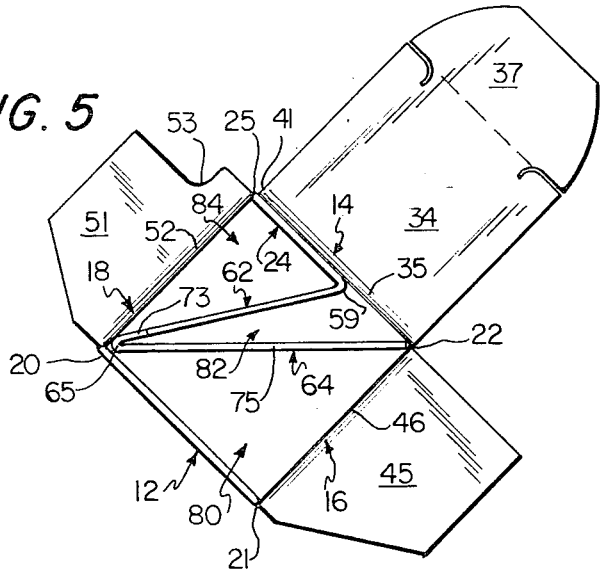
FIG. 7 is an enlarged bottom plan view of the container formed from the blank of FIG. 1 which has been expended from the sleeve configuration shown in FIG. 6.

As seen in FIG. 1, the glue flap 24 tapers as it extends away from fold line 25 along its top edge 55 and bottom edge 56. These edges 55 and 56 converge into line 58 which is parallel to line 25 and comprised of fold line 59 and exposed straight edge 60. The width of the glue flap 24 between lines 58 and 25 is less than the width of rear panel 14 and as seen in FIG. 7 is about two-thirds the width of rear panel 14. The vertical length of fold line 59 is about five-sixths of the overall length of line 58.

As seen on the left side of FIG. 1, a first divider panel 62 hingedly extends along fold line 59 from glue flap 24 and a second divider panel 64 hingedly extends along fold line 65 from the end of the first divider panel 62. The top edge 68 of the first divider panel 62 is substantially in the form of a V-shaped notch and a circular aperture 70 is formed in the middle of the width of panel 62 about one-third up from the bottom edge 71 thereof.

Edge 71 extends from bottom edge 56 of the glue flap into a short indented edge 73 which is at an angle of about 135° from edge 71 and which intersects with fold line 65. Fold lines 59 and 65 are parallel. Edge 71 is perpendicular to line 59.

The second divider panel 64 has a straight bottom edge 75 extending from edge 73 and has a top edge 76 in substantially the form of a V-shaped notch, which is substantially the mirror image of edge 68 on the first divider panel. The distal edge 78 of the second divider panel 64 is straight, is parallel to line 65, and is perpendicular to bottom edge 75. The horizontal width shown in FIG. 1 of the second divider panel 64 is greater than the horizontal width of the first divider panel 62, greater than the width of side panel 18 and greater than the width of front panel 12. The vertical length of the first divider panel 62 is greater than the vertical length of the second divider panel 64 and the horizontal width of panel 62 is greater than the width of side panel 18. The fold line 65 between the divider panels is advantageously perforated so as to aid in relative hinging of these panels.

Referring now to FIGS. 2–6, the folding operation of blank 10 is shown to form the blank into a sleeve configuration, so that it can be utimately expended into a container configuration.

Figure 2:
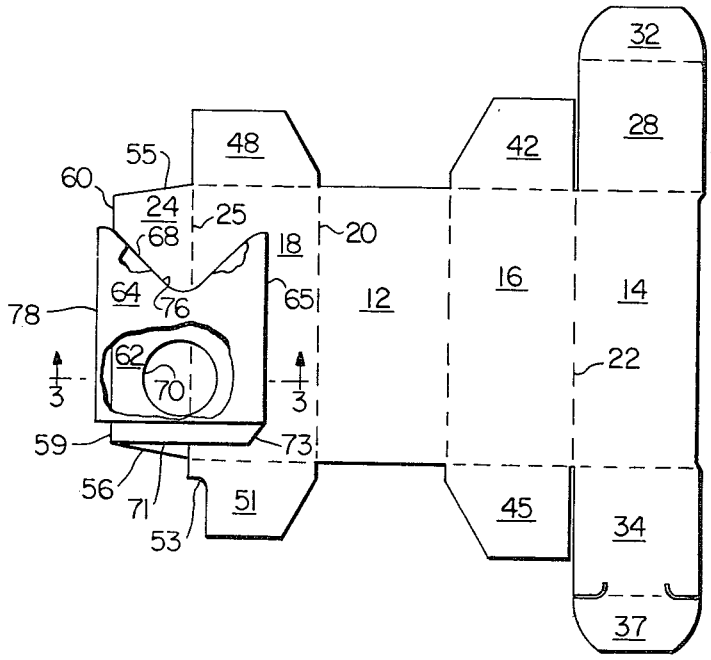
FIG. 2 is a side elevational view, with parts cut away, similar to that seen in FIG. 1; however, the two divider panels have been folded over each other and along a fold line with the glue flap.
Figure 3:
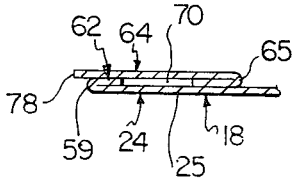
FIG. 3 is a bottom plan view in section taken along lines 3—3 in FIG. 2 showing how the various folded panels overlie one another.

As seen in FIG. 2, two folds have taken place, the first along fold line 59 and the second along fold line 65. Thus, the first divider panel 62 is folded along fold line 59 into an overlying relationship with the glue flap 24 and the second side panel 18. And, in addition, the second divider panel is folded about fold line 65 into an overlying relationship with the outer surface of the first divider panel 62. This is also shown in FIG. 3 in which the overlying relationship is detailed.

Figure 4:
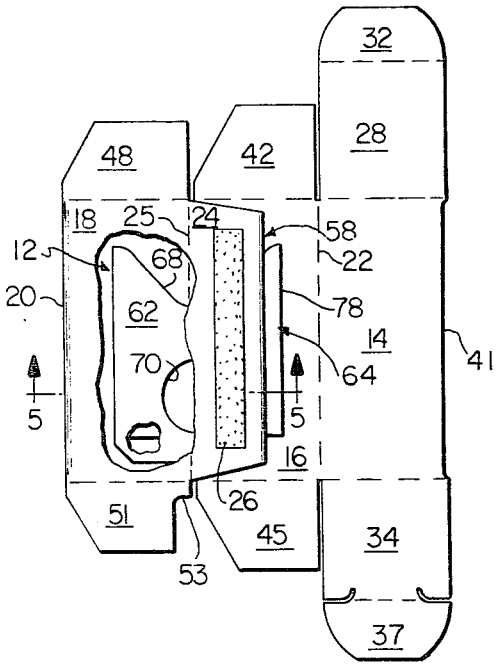
FIG. 4 is a side elevational view, with parts cut away, showing the blank seen in FIG. 2 folded along an additional fold line between a front and side panel, with adhesive having been added.
Figure 5:
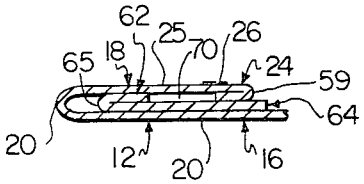
FIG. 5 is a bottom plan view in section taken along lines 5—5 in FIG. 4 showing the overlying configuration of the folded panels depicted therein.

The next fold is shown in FIGS. 4 and 5, in which the second side panel 18, together with the already folded divider panels, is folded along fold line 20 between the second side panel 18 and the front panel 12. This folding results in an overlying of the second divider panel 64 against the front panel 12 and the first side panel 16.

In addition, a strip of adhesive 26 is applied on the outside surface of glue flap 24 extending from the top to the bottom as seen in FIGS. 4 and 5.

Figure 6:
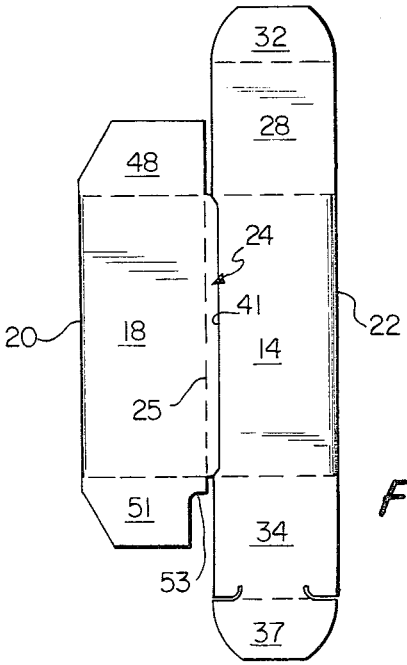
FIG. 6 is a side elevational view showing the blank seen in FIG. 4 but having been folded along the final fold line between the rear panel and a side panel to form the blank into a sleeve configuration.

The final fold of the blank into the sleeve configuration is shown in FIG. 6 in which the rear panel 14 and its associated closure flaps 28 and 34 are folded along fold line 22 so that the rear panel 14 contracts adhesive 26 and is adhered to glue flap 24. Although the adhesive is shown lying on glue flap 24, it could be placed on the rear panel 14 in an appropriate position. In all events, the adhesive is interposed between glue flap 24 and rear panel 14.

As seen in FIG. 7, the bottom view shown therein is of the sleeve completely constructed as in FIG. 6 but expended by exerting pressure along fold lines 20 and 22 as seen in FIG. 6 so that the outer panels pivot around these fold lines as well as fold lines 21 and 24, and the divider panels pivot around fold lines 59 and 65.

The expanded container shown in FIG. 7 has rectangular transverse and longitudinal cross sections, with panels 12, 14, 16 and 18 being substantially planar. In this regard, as seen in FIG. 7, panels 12 and 14 are substantially parallel to each other, panels 16 and 18 are substantially parallel to each other, and panels 18 and 16 are substantially perpendicular to panels 12 and 14. These panels thereby define an enclosed chamber 80 in which are located the first and second divider panels 62 and 64. Specifically, the second divider panel 64 extends completely across and is substantially equal to the diagonal dimension of chamber 80 between the opposed corners defined on the left hand side by fold line 20 between front panel 12 and second side panel 18 and on the right hand side by fold line 22 between the rear panel 14 and the first side panel 16. The distal edge 78 of panel 64 is in substantial contact with both panels 14 and 16.

The glue flap 24 is rigidly secured against the rear panel 14 and has the first divider panel 62 extending therefrom along fold line 59 to its hingable connection with the second divider panel 64 along fold line 65 which is received in and is adjacent to the corner formed by panels 12 and 18, panel 62 substantially contacting panel 18 and panel 64 substantially contacting panel 12. In other words, panel 62 extends a greater distance perpendicularly to the fold lines than either panels 12 and 14 or 16 and 18 and extends from glue flap 24 substantially to a corner formed by one of said parallel fold lines 20, 21 defining a side of front panel 12 opposite glue flap 24.

The first and second divider panels 62 and 64 define therebetween an area 82 having a triangular cross section in which the angle between panels 62 and 64 is acute and is about 10° before the article is placed therein. This area 82 receives the fragile article, as will be described hereinafter in more detail, and the hinged panels 62 and 64 grip opposed sides of the article, the area 82 expanding as the panels 62 and 64 bend and pivot upon reception of the article .

A second triangular area 84 is defined between the first divider panel 62, glue flap 24 and second side panel 18. The first divider panel 62 forms the hypotenuse of this right triangular area as seen in FIG. 7, the angle between glue flap 24 and second side panel 18 being about 90°.

Figure 8:
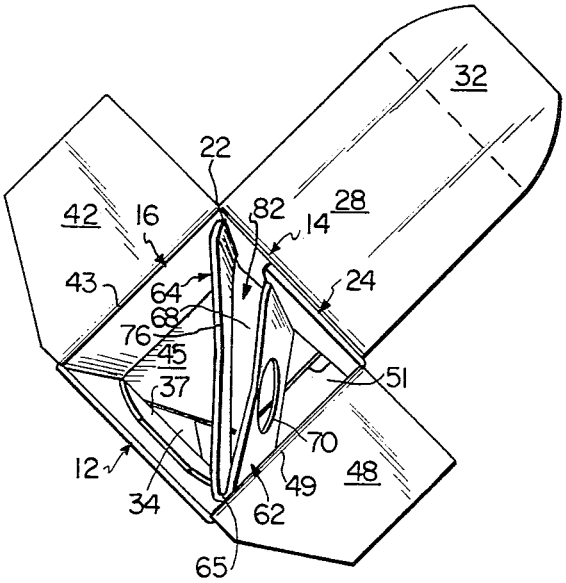
FIG. 8 is an enlarged top perspective view of the expanded sleeve in the form of the fully constructed container shown in FIG. 7.

Referring now to FIG. 8, this is a top perspective view of the container shown in FIG. 7 providing a view of aperture 70 in the first divider panel 62. As seen in FIG. 8, the bottom closure flaps 45, 51 and 34 are in their closed, perpendicular position with locking flap 37 perpendicular to flap 34 and in the locked mode.

Figure 9:
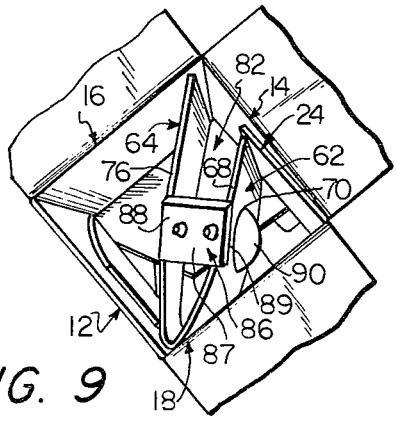
FIG. 9 is a top perspective view similar to that seen in FIG. 8 with a fragile article comprising a base and a bulb portion received and supported between the two divider platforms.

Referring now to FIG. 9, which is a view similar to the view of FIG. 8, it is seen that a fragile article 86, such as a lamp having a parallelopiped base 87 with sidewise extending shoulders 88 and 89 protruding therefrom and a protruding bulb portion 90 extending from base 87, is received and supported between the first and second divider panels 62 and 64 in the area 82. In so receiving the article, the divider panels pivot away from each other, expanding the area 82 therebetween. The panels also bend slightly is thus provided because panel 62 is attached to the glue flap 24, fold line 65 is adjacent fold line 20, and the distal edge 78 of panel 64 contacts side panel 16. This is also accomplished by panel 64 having a width greater than front panel 12. Thus, the expanded panels provide an inward pressure tending to grip the article securely therebetween.

As seen in FIG. 9, the bulb portion 90 partially extends through and is received and supported in aperture 70 for securing the bulb and the entire fragile article 86 therein to prevent upward or downward movement thereof. In addition, the shoulders 88 and 89 of article 86 are respectively received in V-shaped notches in the top edges 76 and 68 of panels 64 and 62 to prevent further downward movement of the fragile article 86, which would otherwise result in possible breakage. It should be noted that the V-shaped notches also act as a funnel to aid in maneuvering the fragile article 86 into its supporting and receiving position shown in FIG. 9.

In all events, the fragile article 86 is securely maintained in the chamber 80 defined by the container's outer panels and is provided a high level of protection during shipment by gripping panels 62 and 64. To close the top of the container, the top closure flaps seen in FIG. 8 including flaps 28, 42 and 48 are folded over, with flap 28 being the outermost and with tuck flap 32 being positioned perpendicular to flap 28 and adjacent front panel 12. In this configuration, all of the top closure flaps are perpendicular to the main panels 12, 14, 16 and 18.

Figure 10:
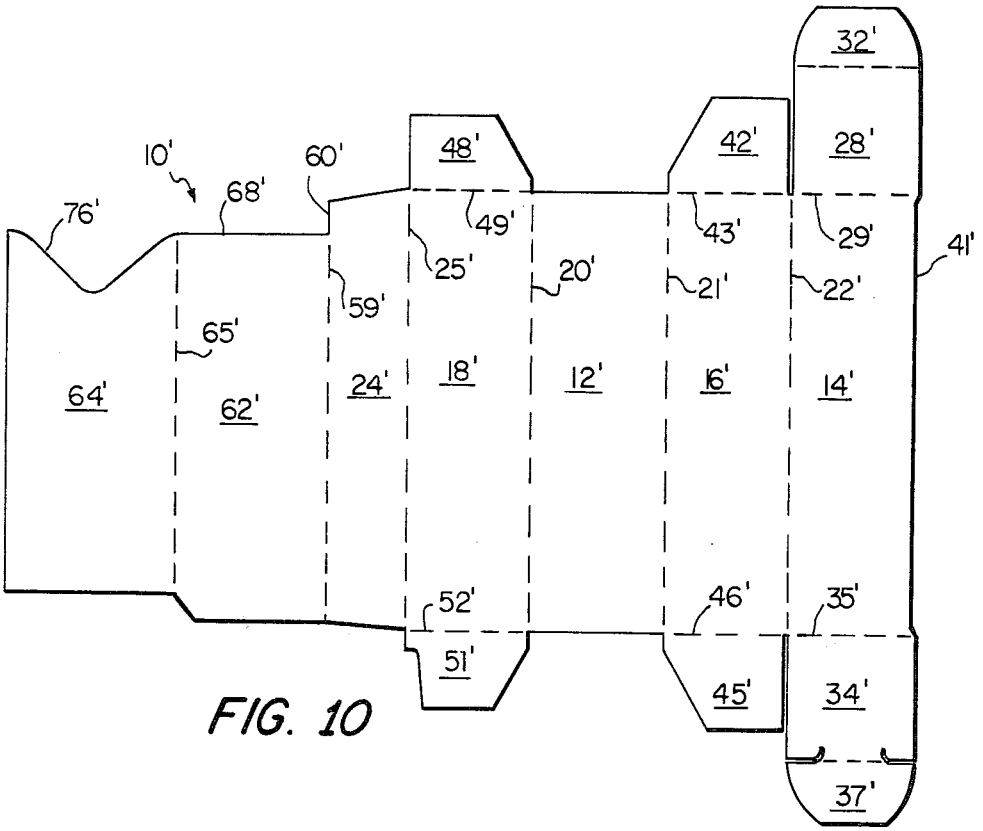
FIG. 10 is a side elevational view showing the inside surface of a modified blank, similar to that shown in FIG. 1; however, the vertical lengths have been enlarged for all of the panels.

Referring now to FIG. 10, a modified blank 10' is shown which is larger in vertical length than the blank 10 shown in FIG. 1. In addition, the first divider panel 62' has a straight top edge 68' and no aperture therein. The remaining parts have the same configuration and connections as blank 10. The character numerals used in FIG. 1 are used in FIG. 10 with the addition of a "prime" to show that they are the same parts with the same configurations and connections, but a greater overall length. Comparing FIGS. 1 and 10, it is seen that the overall vertical lengths of the panels shown therein are about two-thirds the overall vertical lengths of the panels shown in FIG. 10, these two views being in relative scale.

In all events, the blank 10' shown in FIG. 10 is folded and constructed into a sleeve configuration as described above with regard to blank 10 of FIG. 1, and is then expanded into a container configuration similar to that described above. By providing a blank 10' of a slightly larger size, both blanks 10 and 10' can accommodate a large number of different types of fragile articles with varying sizes and shapes. In this regard, automated machinery used to form the blanks need be only slightly modified by changing the lengths of the panels and varying the notch and aperture of the first divider panel to switch over between manufacture of these two types of blanks.

Referring now to FIGS. 11–19, a modified blank and container are shown in which the glue flap is hingedly connected to the rear panel rather than a side panel as described above regarding FIGS. 1–10. This configuration is advantageous to accomplish the objects of the present invention, although the blanks shown in FIGS. 1 and 10 are preferred insofar as they provide a better nesting configuration during die cutting so that less material is wasted.

Figure 11:
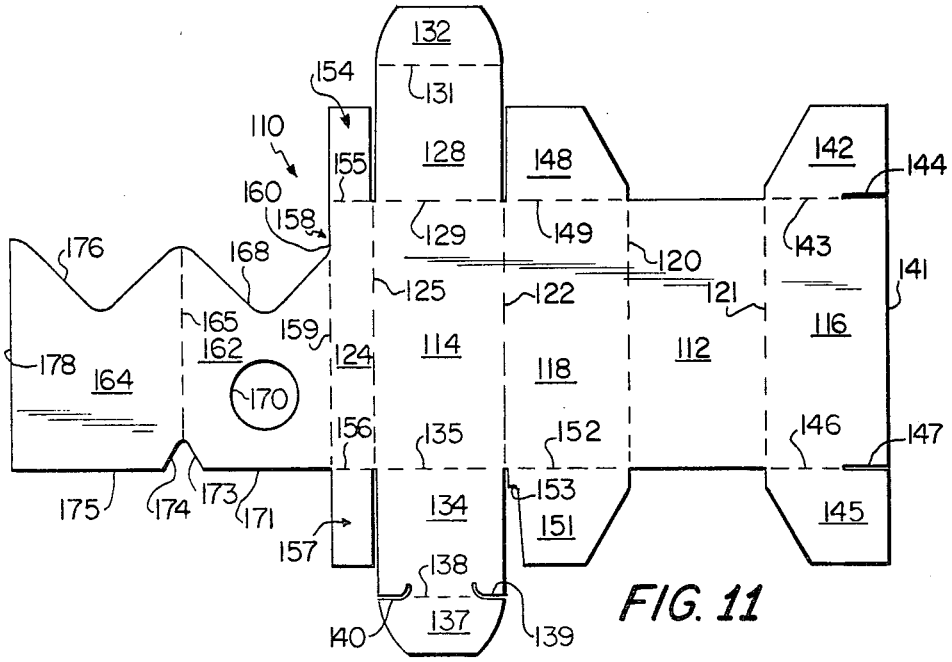
FIG. 11 is a side elevational view of a modified blank in accordance with the present invention showing the inside surface thereof in which the glue flap hingedly extends from the rear panel, the size of this blank corresponding to the size of the blank shown in FIG. 1.

The blank 110 shown in FIG. 11 is comprised of thin, foldable and bendable paper board or cardboard as described above regarding blank 10. Except for the glue flap, its tab extensions, the relative location of the rear panel and the glue flap and the configuration of the second divider panel, blank 110 is substantially the same in configuration and dimensions as blank 10 described above. Accordingly, for the sake of brevity, these dimensions and configurations will not be repeated; however, the differences in the blanks will be specifically set forth.

As seen in FIG. 11, blank 110 is comprised of a front panel 112, a rear panel 114, and first side panel 116 and a second side panel 118. Parallel fold lines 120, 121 and 122 hingedly connects panels 112, 114, 116 and 118. Specifically, fold line 122 is between panels 114 and 118, fold line 120 is between panels 118 and 112, and fold line 121 is between panels 112 and 116. The distal end or edge 141 of the first side panel 116 is straight.

A top closure flap 128 hingedly extends along the top of rear panel 114 along fold line 129 and a tuck flap 132 hingedly extends along fold line 131 from the top of flap 128.

A bottom closure flap 134 hingedly extends along fold line 135 from the bottom of rear panel 114, and locking flap 137 hingedly extends along fold line 138 from the bottom of flap 134, opposed ends of fold line 138 having cut lines 139 and 140 therein The first side panel, on the right as seen in FIG. 11, has a top closure flap 142 hingedly extending along fold line 144 from the top thereof and has a bottom closure flap 145 hingedly extending along fold line 147 from the bottom thereof. Cut lines 144 and 147 extend inwardly respectively along fold lines 143 and 146.

The second side panel 118 has a top closure flap 148 hingedly extending along fold line 149 from the top thereof and has a bottom closure flap 151 hingedly extending along fold line 152 from the bottom thereof. A locking flange 153 is located on flap 151.

The top closure flaps 128, 142 and 148 form the top closure for the container formed from blank 110, with flap 128 being the outermost flap. Flaps 134, 145 and 151 form the bottom closure of the container, with flap 134 being the outermost flap on the bottom.

As seen on the left hand side of FIG. 11, the glue flap 124 is rectangular, has a vertical length equal to the vertical length of rear panel 114 and has a width less than the width of panel 116, being about one-third as seen in FIG. 11. A top tab 154 extends along fold line 155 from the top of glue flap 124, this tab being rectangular and having a length substantially equal to the length of top closure flap 142. Similarly, a bottom tab 157 hingedly extends along fold line 156 from the bottom of glue flap 124. The bottom tab 157 has the same length as bottom closure flap 145.

The first divider panel 162 hingedly extends along fold line 159 from glue flap 124 and the second divider panel 164 hingedly extends along fold line 165 from the first divider panel. Fold lines 165 and 159 are parallel. Divider panels 162 and 164 have respective top edges 168 and 176 in the form of substantially V-shaped notches. Panel 164 is wider than panel 162, panel 114 and panel 118. Panel 162 is wider than panel 112.

As seen in FIG. 11, straight line 158 is formed from fold line 159 and short straight line 160 which is a free edge of glue flap 124.

A circular aperture 170 is located in the center of the width of the first divider panel 162 and a bottom straight edge 171 on panel 162 extends from fold line 156. Edge 171 extends into upwardly extending edge 173 which intersects fold line 165 and then continues into edge 174 which extends downwardly into bottom edge 175 on the second divider panel 164. Edges 171 and 175 are substantially in the same straight line.

Referring now to FIGS. 12–16, it is seen that blank 110 is folded into a sleeve configuration by means of only three folding actions.

Figure 12:
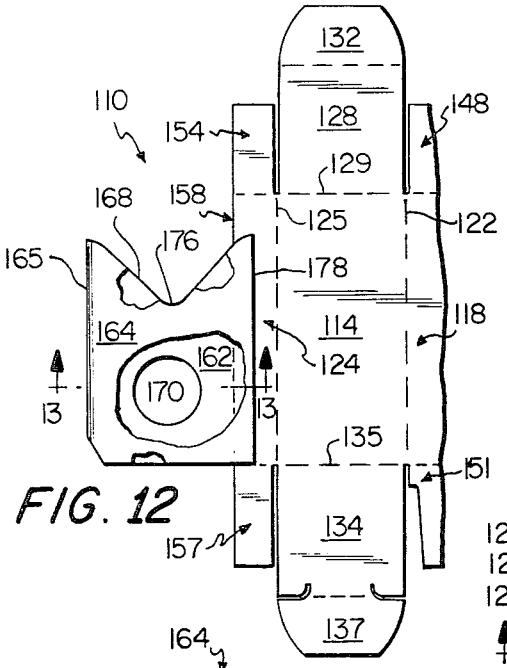
FIG. 12 is a fragmentary side elevational view, with parts cut away, showing the blank seen in FIG. 11 with one of the divider panels folded over the other divider panel.
Figure 13:
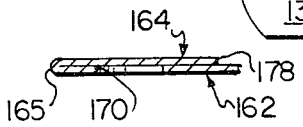
FIG. 13 is a bottom plan view in section taken along lines 13—13 in FIG. 12 showing the overlying configuration of the divider panels therein.

As seen in FIGS. 12 and 13, the first fold is accomplished along fold line 165 between the first divider panel 162 and the second divider panel 164. This fold is accomplished by means of pivoting divider panel 164 onto divider panel 162. In addition, the edge 178 of panel 164 overlies the glue flap 124.

Figure 14:
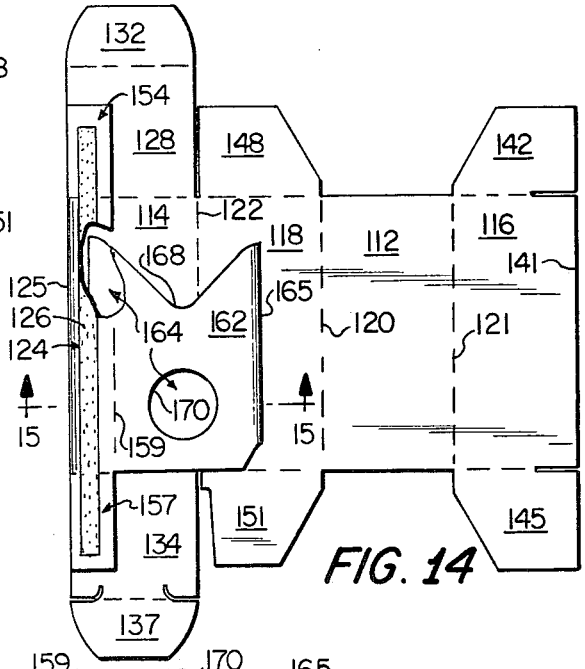
FIG. 14 is a side elevational view, with parts cut away, showing the folded blank seen in FIG. 12 except that the glue flap has been folded relative to the rear panel and showing adhesive added thereto.
Figure 15:
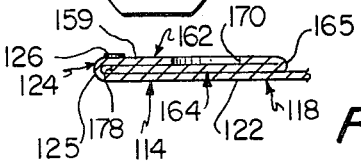
FIG. 15 is a bottom plan view in section taken along lines 15—15 showing the overlying panels set forth in FIG. 14.

As seen in FIGS. 14 and 15, the second fold has been accomplished in which the glue flap 124 and its associated tabs 154 and 157 have been folded along fold line 125, carrying with them the previously folded divider panels. In this configuration, the second divider panel 164 overlies rear panel 114 and a portion of side panel 118 and glue flap 124 overlies a portion of rear panel 114, with the second divider panel being interposed therebetween. Above and below the glue flap 124 tabs 154 and 157 overlie top closure flap 128 and bottom closure flap 134, respectively.

As seen in FIGS. 14 and 15, a strip of adhesive 126 is applied along glue flap 124 and tabs 154 and 157.

Figure 16:
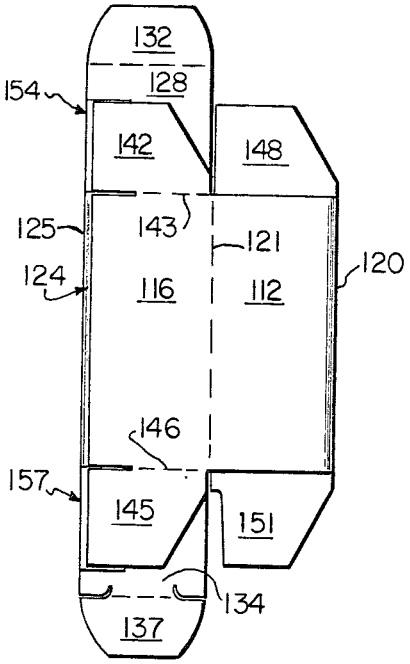
FIG. 16 is a side elevational view showing the blank of FIG. 14 fully folded into the sleeve configuration.

The next and final folding step is shown accomplished in FIG. 16 in which the front panel 112 is folded along fold line 120 carrying with it side panel 116 and top and bottom closure flaps 142 and 145. In the folded position shown in FIG. 16, the front panel 112 overlies the second side panel 118 and the first divider panel 162. In addition, the first side panel 116 overlies the first divider panel 162 and the rear panel 114. A contact between the first side panel 116 and the glue flap 124 is accomplished after that fold is made so that glue flap 124 and side panel 116 are adhered together in the sleeve configuration. In addition, the top closure flap 142 associated with side panel 116 overlies tab 154 and is adhered thereto by adhesive 126. Similarly, bottom closure flap 145 overlies and is adhered to bottom tab 157 by means of adhesive 126. Although the adhesive is shown as being applied to the glue flap and tabs, it could also be applied in the appropriate places to side panel 116 and flaps 142 and 145.

Figure 17:
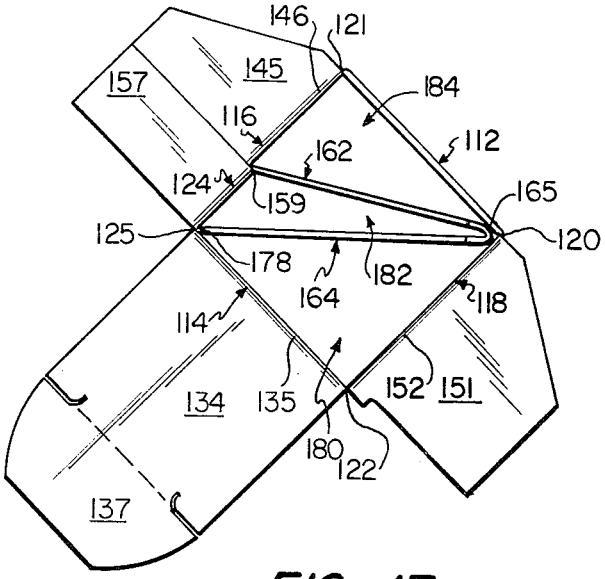
FIG. 17 is an enlarged bottom plan view of the sleeve shown in FIG. 16 which has been expended into the container configuration.

Referring now to FIG. 17, a bottom view is shown of the container formed from blank 110 which has been expanded from the sleeve configuration shown in FIG. 16. This expansion is provided by pressure inwardly exerted from opposed fold lines 120 and 125 so that a folding of the various panels occurs about fold lines 120, 121, 122 and 125, as well as lines 159 and 165, to provide an enclosed chamber 180 formed by panels 112, 114, 116 and 118. This chamber has longitudinal and transverse cross sections which are rectangular, these walls or panels being planar as seen in FIG. 17. Specifically, panels 112 and 114 are opposed and parallel to each other, panels 116 and 118 are opposed and parallel to each other, and panels 112 and 114 are perpendicular to panels 116 and 118.

An area 182 is defined between the first divider panel 162 and the second divider panel 164 which is triangular in cross section. The angle between divider panels 162 and 164 is acute, seen in FIG. 17 as being about 10°. It is this area 182 in which the fragile article is received and supported between the divider panels 162 and 164, as similarly shown and discussed above regarding FIG. 9.

An additional triangular area 184 is defined by the first divider panel 162, the front panel 112 and the portion of side panel 116 between glue flap 124 and front panel 112. This is a right triangular area in which the first divider panel 162 is the hypotenuse.

As seen in FIG. 17, the first divider panel 162 extends along fold line 159 from glue flap 124 into the corner defined by front panel 112 and side panel 118 and into substantial contact with panel 112. The panel 162 is hingedly connected along fold line 165 to the second divider panel 164 which extends from that corner and in substantial contact with panel 118 to the opposed corner defined between the glue flap 124 and rear panel 114 and into substantial contact with the panel and flap. The overall width of the second divider panel 164 is substantially equal to the diagonal dimension between the last two mentioned corners and is at least greater than the width of panel 118. Fold line 165 is at least greater than the width of panel 118. Fold line 165 is adjacent and received in the corner of panels 112 and 118.

Figure 18:
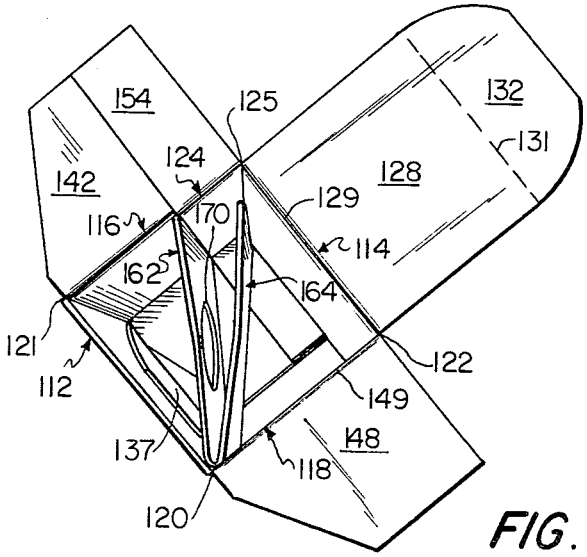
FIG. 18 is a top perspective view of the expanded sleeve in the form of the fully constructed container shown in FIG. 17.

Referring now to FIG. 18, a top perspective view of the formed container shown in FIG. 17 is depicted in which the circular aperture 170 is clearly seen in the first divider panel 162. The operation of the container shown in FIG. 18 is the same as that described above with regard to the container shown in FIGS. 8 and 9.

As seen in FIGS. 17 and 18, the top and bottom closures described above regarding blank 110 can be utilized to close the top and bottom of the container by maneuvering these flaps to positions perpendicular to the front, rear and side panels.

Figure 19:
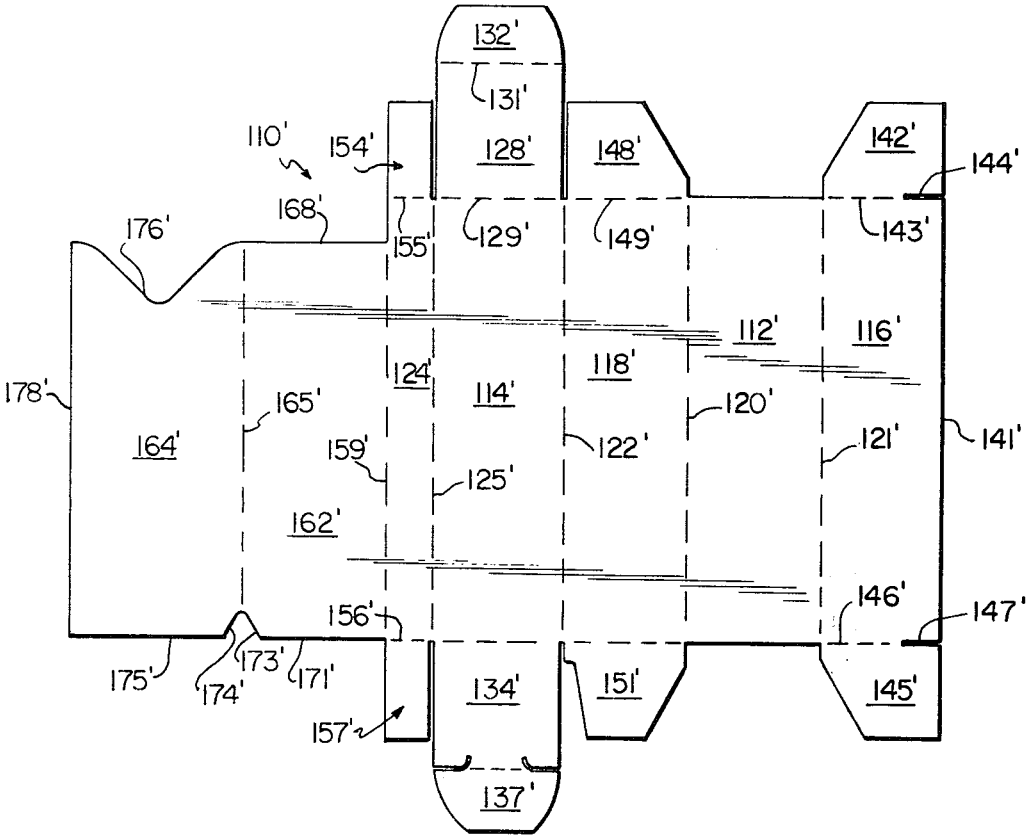
FIG. 19 is a side elevational view showing the inside surface of a modified blank similar to that shown in FIG. 10; however, the vertical lengths of the panels have been increased.

Referring now to FIG. 19, a modified blank 110' is shown which is similar to the blank 110 shown in FIG. 11; however, the vertical lengths of the panels are increased in a fashion similar to that discussed above with regard to the blanks 10 and 10' of FIGS. 1 and 10. Like character numerals with a "prime" added to FIG. 19 reflect the same part discussed above with regard to blank 110 in FIG. 11 but which are longer. The differences in configuration are the same as discussed above between FIGS. 1 and 10, except there remains in the blank of FIG. 19 a notch defined by edges 173' and 174' between edges 175' and 171'.

Referring now to FIG. 20, another modified blank 210 is shown which is broadly similar to the blanks 10 and 10' respectively shown in FIGS. 1 and 10. Blank 210 is comprised of a front panel 212, a rear panel 214, a first side panel 216 and a second side panel 218, all of which are rectangular and are hingedly connected respectively along parallel fold or hinge lines 220, 221 and 222. In addition, a glue flap 224 hingedly extends along fold line 225 from an edge of the second side panel 218. Panels 212, 214, 216 and 218 have the same vertical length as the corresponding panels shown in FIG. 10.

The first side panel 216 and the second side panel 218 are on opposed sides of the front panel 212, the sides being defined by fold lines 220 and 221. The second side panel 218 is interposed between the glue flap 224 and the front panel 212. The sides of the second side panel 218 are fold lines 220 and 225. The first side panel 216 is interposed between front panel 212 and rear panel 214, the rear panel hingedly extending along fold line 222 from the first side panel 216. The width and length of the two side panels are the same and the width and length of the front and rear panels are the same.

The rear panel 214 has a rectangular top closure flap 228 hingedly extending along fold line 229 from the top thereof and closure flap 228 has hingedly extending along fold line 231 at the top thereof a tuck flap 232. The length of flap 228 is about equal to the width of panel 216.

The rear panel 214 also has a rectangular bottom closure flap 234 hingedly extending along fold line 235 from the bottom thereof, which closure flap has a locking flap hingedly extending from the bottom thereof along fold line 238. On opposed sides of the fold line 238 are cut lines 239 and 240. A substantially straight distal edge 241 on panel 214 extends between and is perpendicular to fold lines 229 and 235. The length of flap 234 is about equal to the width of panel 216.

The second side panel 216 has a top closure flap 242 in the form of a substantially right trapezoid extending along the top thereof from fold line 243. The length of the top closure flap 242 is less than the length of top closure flap 228 and is substantially equal to the width of front panel 212.

A bottom closure flap 245 having a substantially right trapezoidal shape hingedly extends along fold line 246 from the bottom of second side panel 216. The dimensions of this closure flap are the same as closure flap 242.

The first side panel 218 has a top closure flap 248 in the form of a substantially right trapezoid which hingedly extends from the top of panel 218 along fold line 249. A bottom closure flap 251 hingedly extends along fold line 252 from the bottom of side panel 218, this closure flap also being substantially in the form of a right trapezoid; however, a recess is formed on the left edge thereof to define a locking flange 253. These two closure flaps 248 and 251 are smaller than closure flaps 242 and 245.

The top closure flaps 228, 242 and 248 form the top closure for the container, with flap 228 being the outermost top closure flap upon closing of the container.

The bottom closure flaps 234, 245 and 251 form the bottom closure for the container, with flap 234 being the outermost flap on the bottom closure once the container is closed at the bottom.

Fold lines 249, 243 and 229 extend along the same line, and fold lines 252, 246 and 235 extend along the same line. Fold lines 249, 243 and 229 are parallel to fold lines 252, 246 and 235 and all of these fold lines are perpendicular to fold lines 225, 220, 221 and 222.

The glue flap 224 tapers very slightly as it extends away from fold line 225 along its top edge 255 and bottom edge 256. These edges 255 and 256 extend to fold line 258, which is parallel to line 225. The width of the glue flap 224 between lines 258 and 225 is less than the width of rear panel 214 and is about two-thirds the width of rear panel 214.

As seen on the left side of FIG. 20, a first divider panel 262 hingedly extends along fold line 258 from glue flap 224 and a second divider panel 264 hingedly extends along fold line 265 from the end of the first divider panel 262. The top edge 268 of the first divider panel 262 is substantially in the form of a V-shaped notch and a tear-drop shaped aperture 270 is formed in the middle of the width of panel 262 about one-third up from the bottom edge 271 thereof. Edge 271 extends from bottom edge 256 of the glue flap 224 to the bottom edge 275 of the second divider panel 264. Fold lines 258 and 265 are parallel, while edges 271 and 275 are perpendicular to line 258.

The second divider panel 264 has a top edge 276 in substantially the form of a V-shaped notch, which extends somewhat more deeply therein compared to the edge 268 on the first divider panel. The distal edge 278 of the second divider panel 264 is straight, is parallel to line 265, and is perpendicular to bottom edge 275. The horizontal width shown in FIG. 20 of the second divider panel 264 is greater than the horizontal width of the first divider panel 262, greater than the width of side panel 218 and greater than the width of front panel 212. The vertical lengths of the first divider panel 262 and second divider panel 264 are equal and the horizontal width of panel 262 is greater than the width of side panel 218. The fold line 265 between the divider panels is advantageously perforated so as to aid in relative hinging of these panels.

Second divider panel 264 is provided with a tear-drop shaped aperture 279 therein similar in placement and configuration to aperture 270 in first divider panel 262. The particular shape of the apertures 270 and 279 will be determined by the geometry of the specific article to be contained however. First and second divider panels 262 and 264 are respectively provided with fold lines 280 and 281 which are preferably scored and extend parallel to line 258 between the corresponding troughs of the edges 268 and 276 to the apex of the apertures 270 and 279.

Aperture 270 is defined in part by a pair of divergent cut lines 282 and 283 extending downwardly and away from line 280, while aperture 279 is similarly defined in part by a pair of divergent cut lines 284 and 285 extending downwardly and away from line 281. First divider panel 262 includes a pair of divergent fold lines 286 and 287 respectively aligned with the cut lines 282 and 283 and extending between the aperture 270 and the lower corners thereof. Second divider panel 264 likewise includes a pair of divergent fold lines 288 and 289 respectively aligned with the cut lines 284 and 285 and extending between the aperture 279 and the lower corners thereof. Fold lines 286–289 are preferably scored to facilitate bending therealong.

Fold line 280 divides the first divider panel 262 into a first and second portion **262*a* and 262*b* respectively, while fold line 281 divides the second divider panel 264 into a first and second portion 264*a* and 264*b*** respectively.

The blank 210 is folded and constructed into a sleeve configuration as previously described with reference to the blank 10 of FIG. 1 and then expanded into a container configuration similar to that described above. As shown in FIG. 21, when expanded into the container configuration, the lower portions of the divider panels 262 and 264 respectively designated by the numerals 290 and 291 form a V-shaped wedge. Portions 290 and 291 are narrowly spaced apart the lower part of a fragile article (not shown) and prevent the same from contacting either the ends or sides of the container, while the apertures 270 and 279 provide a cradle-like receptacle which receive portions of the article therewithin and tend to lock the same in safe, spaced relationship to the ends and sides of the container. The compressive wedging action of portions 290 and 291 further contribute to the locking action afforded by apertures 270 and 279.

First and second portions **262*a* and 262*b*, and 264*a* and 264*b* pivot about corresponding fold lines 280 and 281 to produce V-shaped walls which conformingly engage the sides of the fragile article to be contained and further function to relieve stress transmitted to the lower portions 290 and 291 which would otherwise cause the latter to bend in a manner to reduce the wedging effect provided thereby. Fold lines 286–289 likewise function to relieve the lower portions 290 and 291** from stress transmission that would cause the same to bow outwardly away from each other and diminish the wedging effect.

While advantageous embodiments have been chosen to illustrate the present invention, it will be understood by those skilled in the art that various changes and modification can be made therein without departing from the scope of the invention as defined in the appended claims.

What is claimed is:

1. A container having an internal support for a fragile article comprises:

a front panel, a rear panel, and first and second side panels hingedly connected along generally parallel fold lines forming an enclosed chamber;

a glue flap interconnecting one of said side panels or said rear panel; and divider means located in said chamber for supporting the fragile article, said divider means including a first divider panel hingedly extending along a fold line from said glue flap to a corner formed by one of said parallel fold lines defining a side of a panel opposite said glue flap and a second divider panel hingedly extending along a fold line from said first divider panel at said corner to a diagonally opposite corner.

2. A container according to claim 1, wherein said first divider panel has a substantially V-shaped notch in the top edge thereof.

3. A container according to claim 1, wherein said first divider panel has a substantially straight top edge.

4. A container according to claim 1, wherein said first divider panel has a length less than the length of said front panel.

5. A container according to claim 1, wherein said first divider panel has an aperture therein for receiving a portion of the fragile article.

6. A container according to claim 1, wherein said second divider panel has a substantially V-shaped notch in the top edge thereof.

7. A container according to claim 6, wherein said first divider panel has a substantially V-shaped notch in the top edge thereof.

8. A container according to claim 1, and further comprising a top closure including at least one top closure flap hingedly extending along a fold line from the top of and perpendicular to one of said panels.

9. A container according to claim 1, and further comprising a bottom closure including at least one bottom closure flap hingedly extending along a fold line from the bottom of and perpendicular to one of said panels.

10. A container according to claim 1, wherein said glue flap hingedly extends along a fold line from and perpendicular to one of said side panels.

11. A container according to claim 1, wherein said glue flap hingedly extends along a fold line from and perpendicular to said rear panel.

12. A container according to claim 11, wherein said side panel interconnected with said rear panel by said glue flap has top and bottom closure flaps hingedly extending along respective fold lines from and perpendicular to said side panels, and said glue flap has top and bottom tabs extending along respective fold lines from and perpendicular to said glue flap and contacting said top and bottom closure flaps.

13. A container according to claim 1, wherein said first and second divider panels have an acute angle defined therebetween.

14. A container according to claim 1, wherein said chamber has longitudinal and transverse rectangular cross-sections, said second divider panel having a width substantially equal to the diagonal, transverse dimension of said chamber between opposing corners thereof.

15. A container according to claim 1, wherein said first divider panel, said glue flap and one of said side panels define an enclosed area having a triangular cross-section.

16. A container according to claim 15, wherein said triangular cross-section is in the form of a right triangle, said first divider panel forming the hypotenuse thereof.

17. A container according to claim 1, wherein said first divider panel, said glue flap and said front panel define an enclosed area having a triangular cross-section.

18. A container according to claim 17, wherein said triangular cross-section is in the form of a right triangle, said first divider panel forming the hypotenuse thereof.

19. A container according to claim 1, wherein said chamber has a substantially rectangular transverse cross-section, said second divider panel extends between two opposed corners of said rectangular chamber, the first corner being defined by the side panel interconnected with said rear panel by said glue flap and by said front panel, the second corner being defined by the other side panel and said rear panel.

20. A container according to claim 1, wherein said chamber has a substantially rectangular transverse cross-section, said second divider panel extends between two opposed corners of said rectangular chamber, the first corner being defined by said glue flap and said rear panel, the second corner being defined by said front panel and the side panel opposed to the other side panel interconnected by said glue flap with said rear panel.

21. A container according to claim 1, wherein said first and second divider panels have an acute angle defined therebetween, said first divider panel has a width greater than the width of one of said side panels, and said second divider panel has a width greater than said front panel.

22. A container according to claim 1, wherein said first and second divider panels have an acute angle defined therebetween, said angle being about 10 degrees.

23. A container according to claim 1, wherein said fold line between said first and second divider panels is adjacent at least one of said front and side panels.

24. A container according to claim 1, wherein said second divider panel has a distal edge contacting at least one of said rear panels and said glue flap.

25. A container according to claim 1, wherein at least one of said divider panels is provided with a first, second and third fold line therein extending radially from a medial region in said at least one divider panel and outwardly toward the edges of said latter mentioned panel.

26. A container according to claim 25, wherein each of said first and second divider panels is provided with said first, second and third fold line therein, and further include an aperture therethrough in said medial region thereof, and said first fold line extends longitudinally in the associated divider panel to one edge of the latter.

27. A container according to claim 26, wherein each of said first and second divider panels are generally rectangular in shape and said second and third fold lines therein extend to corresponding adjacent corners thereof and away from the associated said one edge thereof.

28. A unitary blank for a carton having an internal support for a fragile article comprises:

a front panel, a rear panel, and first and second side panels hingedly extending along generally parallel fold lines to form a chamber;

a glue flap hingedly extending along a fold line from one of said panels other than said front panel;

a first divider panel hingedly extending along a fold line from said glue flap; and a second divider panel hingedly extending along a fold line from said first divider panel;

said first and second divider panels being arranged in an erected state such that said first divider panel extending from said glue flap to a corner formed by one of said parallel fold lines defining a side of a panel opposite said glue flap and said second divider panel extending from said first divider panel at said corner to a diagonally opposite corner.

29. A blank according to claim 28, and further including at least one top closure flap hingedly extending along a fold line from the top of one of said rear and side panels, and at least one bottom closure flap hingedly extending along a fold line from the bottom of one of said rear and side panels.

30. A blank according to claim 28, wherein said first divider panel has a substantially V-shaped notch in the top edge thereof.

31. A blank according to claim 28, wherein said first divider panel has a substantially straight top edge.

32. A blank according to claim 28, wherein said first divider panel has an aperture therein.

33. A blank according to claim 32, wherein said aperture is circular.

34. A blank according to claim 28, wherein said second divider panel has a substantially V-shaped notch in the top edge thereof.

35. A blank according to claim 28, wherein said second divider panel has a width greater than the width of said first divider panel.

36. A blank according to claim 28, wherein said glue flap extends from one of said side panels.

37. A blank according to claim 28, wherein said glue flap extends from said rear panel.

38. A blank according to claim 37, wherein said glue flap has top and bottom tabs extending along fold lines from the top and bottom thereof.

39. A blank according to claim 28, wherein said first and second divider panels each are provided with a plurality of fold lines extending radially from medial regions therein.

40. A blank according to claim 39, wherein said first and second divider panels are each provided with an aperture in said medial regions thereof.

41. A blank according to claim 40, wherein each of said first and second divider panels are generally rectangular in shape, and said plurality of fold lines includes a first fold line extending longitudinally from the corresponding aperture to one edge of the associated divider panel, and second and third fold lines extending from said corresponding aperture and away from said first fold line toward adjacent corners of said associated divider panel.

* * * * *